US006407495B1

(12) United States Patent
Bardell et al.

(10) Patent No.: US 6,407,495 B1
(45) Date of Patent: Jun. 18, 2002

(54) ELECTRON BEAM TUBE HAVING PARTICULAR STRUCTURE OF THE VACUUM ENVELOPE CONTAINING ELECTRON GUN

(75) Inventors: Steven Bardell, Nr. Great Dunmow; Steven Aitken, Chelmsford, both of (GB)

(73) Assignee: EEV Limited, Essex (GB)

( * ) Notice: Subject to any disclaimer, the term of this patent is extended or adjusted under 35 U.S.C. 154(b) by 0 days.

(21) Appl. No.: 09/275,109

(22) Filed: Mar. 24, 1999

(30) Foreign Application Priority Data

Mar. 24, 1998 (GB) ..... 9806129

(51) Int. Cl.[7] ..... H01J 25/02

(52) U.S. Cl. ..... 313/477 R; 315/5; 315/5.37; 315/5.39

(58) Field of Search ..... 313/477 R; 315/5, 315/5.33, 5.37, 5.39, 382, 382.1, 381, 15

(56) References Cited

U.S. PATENT DOCUMENTS 5,682,084 A 10/1997 Langlois et al. ..... 315/5.32
5,990,621 A * 11/1999 Sobieradzki ..... 315/5

FOREIGN PATENT DOCUMENTS

| | | |
|---|---|---|
| EP | 0652580 A1 | 10/1995 |
| GB | 2283853 | 5/1995 |
| GB | 2284297 | 5/1995 |
| GB | 2303243 | 2/1997 |

* cited by examiner

*Primary Examiner*—Nimeshkumar D. Patel
*Assistant Examiner*—Karabi Guharay
(74) *Attorney, Agent, or Firm*—Donald C. Casey, Esq.

(57) ABSTRACT

An electron beam tube includes an electron gun included within a vacuum envelope defined partly by a ceramic cylinder. The ceramic cylinder includes straight sided portions and with an intervening conical section between them. The straight sided portions and form part of two r.f. chokes, being metallized on their inner and outer surfaces and forming a connection with a cavity forming part.

14 Claims, 2 Drawing Sheets

Figure 1:
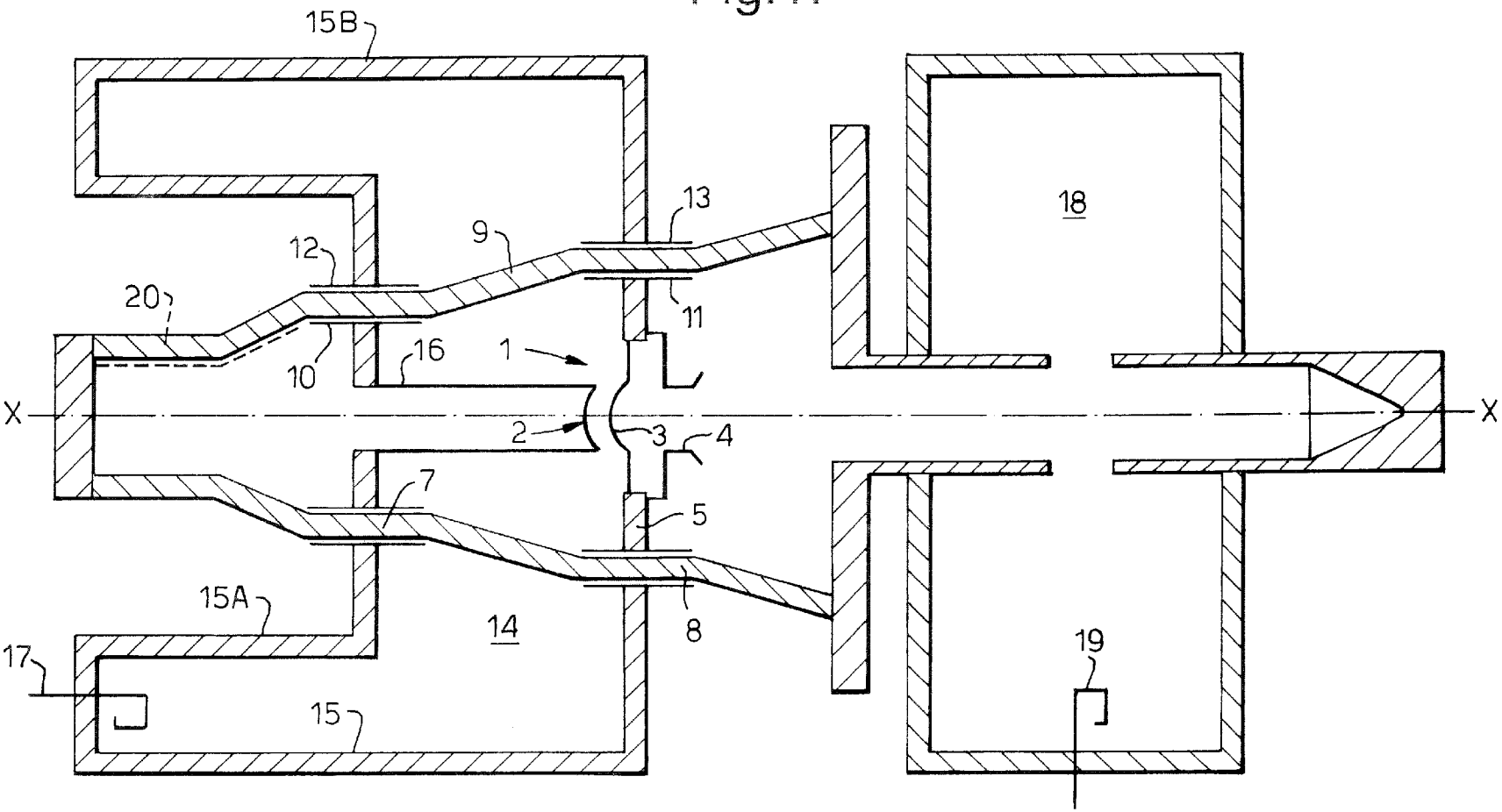

ELECTRON BEAM TUBE HAVING PARTICULAR STRUCTURE OF THE VACUUM ENVELOPE CONTAINING ELECTRON GUN

FIELD OF THE INVENTION

This invention relates to electron beam tubes and more particularly to those for use in amplifying a high frequency signal, for example, for use in an inductive output tube (IOT) amplifier.

BACKGROUND TO THE INVENTION

In an IOT, a high frequency input signal is applied in the region between a cathode and adjacent grid of an electron gun via an input cavity to modulate the electron beam generated at the cathode. An amplified high frequency output signal is coupled from an output cavity.

SUMMARY OF THE INVENTION

According to the invention, there is provided an electron beam tube for use in amplifying a high frequency signal comprising: a vacuum envelope containing an electron gun, the vacuum envelope including a ceramic cylinder having two straight-sided sections with a conical section therebetween them, the straight-sided sections forming part of r.f. choke means.

Use of the invention facilitates attaching the external part of a high frequency resonant cavity to the tube and enables good electrical connections to be easily made. The configuration of the ceramic cylinder enables the tube to be simply dropped into place in a cavity-forming part instead of, as in prior art arrangements, having to accurately fit the cavity components up against the vacuum envelope.

Preferably, metallisation is included on the outer surface of the straight-sided sections. The metallisation may cover only part or all of the outer surface of the straight-sided sections. The metallisation may cover a larger surface area than is necessary to adjoin the mating portion of the cavity-forming part to relax tolerancing requirements, as good electrical connection will still then be achieved if the axial alignment of the components to be joined is not completely correct. The metallisation on the outer surface may form by itself one plate of the rf choke means or may adjoin a metal component such that together they act as a plate. Alternatively, metallisation may be omitted and a metal component brazed to one or both straight-sided sections.

Preferably, the inner surface of the straight-sided sections of the ceramic cylinder are metallised. However, one or both of them may have a metal component brazed thereto.

The metallisation may also extend along the inner and/or outer surfaces of the ceramic cylinder adjacent the straight-sided sections. For example, the metallisation on the outer and/or inner straight-sided sections may continue to cover some of the conical section surface also. This leads to a longer if choke or chokes which may provide a further reduction in the amount of rf energy passing through the choke.

In a preferred embodiment, the ceramic cylinder has a wall of substantially uniform thickness along its length. However, in some embodiments, there may be a variation in thickness. The outer surface only of the ceramic cylinder may be conical, whilst its inner diameter remains constant along the length of the conical section, such that the wall thickness changes.

Preferably, the diameter of the conical section increases in the direction in which electrons of the electron beam travel.

In one advantageous arrangement, metallisation is included along the interior of the ceramic cylinder to make connections to an electrode or electrodes of the electron gun.

The electron beam tube may be included in an IOT amplifier but the invention may find applications in other types of device.

According to a feature of the invention, there is provided a high frequency cavity-forming part adapted for use with the electron beam tube in accordance with the invention.

Figure 2:
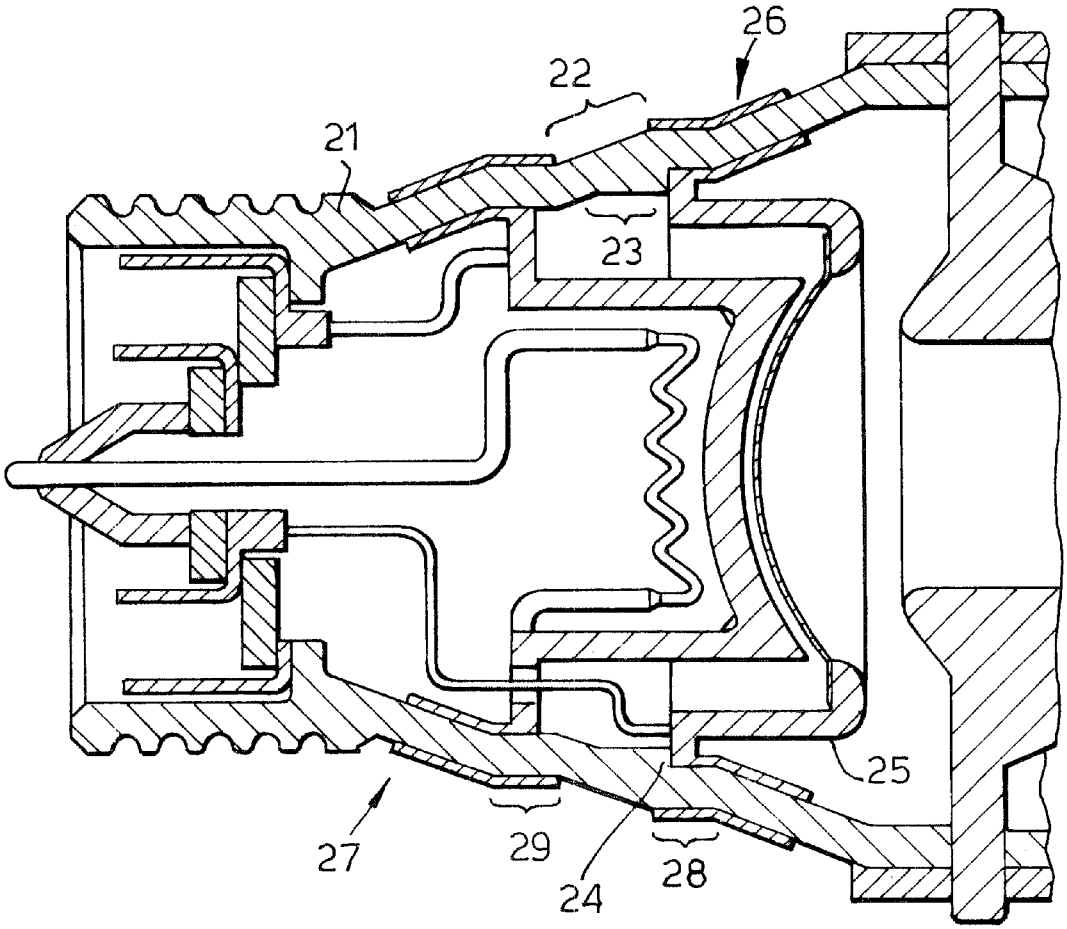

Some ways in which the invention may be performed are now described by way of example with reference to the accompanying drawing, in which:

FIG. 1 schematically illustrates an electron beam tube in accordance with the invention; and FIG. 2 shows part of another electron beam tube in accordance with the invention.

With reference to FIG. 1, an IOT amplifier arrangement includes electron beam tube having an electron gun 1 with a cathode 2 and control grid 3 located in front thereof. A focus electrode 4 is carried on the grid support 5.

The vacuum envelope of the tube includes a ceramic cylinder 6 which surrounds the electron gun 1 and is coaxial therewith along the longitudinal axis X—X. The ceramic cylinder 6 includes straight sided-sections 7 and 8, where the diameter of the cylinder is uniform in its axial direction, with an intervening conical section 9 the diameter of which increases in the direction in which electrons from the cathode travel during operation of the tube. Thus, straight-sided section 8 near the grid support 5 is of larger diameter than that section 7 at the cathode support. The inner surface of the ceramic cylinder 6 is metallised at 10 and 11 around the straight-sided sections. Similarly, the outer surface at sections 7 and 8 is metallised at 12 and 13.

A high frequency resonant input cavity 14 is partially defined by a metal annular cavity-forming part 15 located around the outside of the ceramic cylinder 6 and positioned such that the inner wall 15A of the annular cavity-forming part 15 is fitted adjacent the metallisation 12 on the outer surface of straight-sided section 7 and the outer wall 15B is connected to the metallisation 13 on the outer surface of straight sided section 8. Similarly, within the vacuum envelope, part of cathode support 16 is connected to the metallisation 10 on the inner surface of straight-sided section 7 and the grid mount 5 is electrically and mechanically connected to metallisation layer 11 on the inner surface of straight-sided section 8. The conical section 9 of the ceramic cylinder 6 acts as a window to applied high frequency energy coupled into the input cavity 14 via coupling loop 17 to be directed to the cathode/grid region. The input cavity 14 may be termed an "external" cavity because it is partially defined by a cavity-forming part 15 which is external to the vacuum envelope which includes the ceramic cylinder 6. The cavity-forming part 15 may be readily removed from the tube to allow for servicing or repair because of the conical geometry of the cylinder 6. In use, the cavity-forming part 15 is maintained at ground potential whereas the cathode 2, grid 3 and focus electrode 4 are at relatively high potentials, of the order of kilovolts.

The arrangement also includes an output cavity 18 and coupling means 19 via which an amplified high frequency signal is extracted from the arrangement.

The straight-sided sections 7 and 8 form part of r.f. choke means, together with the metallisation 10, 11, 12 and 13 on their surfaces. This prevents leakage of high frequency energy from the input cavity 14 whilst giving d.c. isolation from components within the vacuum envelope. In other embodiments where there is no metallisation on the ceramic surfaces, mating parts carried by the cavity-forming part 15 may be included in the r.f. choke means but this is less likely to give good electrical connections.

The inner surface of ceramic cylinder 6 includes a separate metallisation track 20 (shown as a broken line) via which an electrical potential is applied to the cathode 2.

In other embodiments of the invention, metallisation 10, 11, 12 or 13 may be extended so as to also cover part of the conical section 9, whilst still providing a sufficiently large window for high frequency to be transmitted therethrough. Part of the conical section 9 is thus also included as part of the rf choke or chokes. In addition, or alternatively, metallisation 10, 11, 12 or 13 may also continue along part of ceramic cylinder 6 adjacent thereto and not forming part of the intervening conical section 9. These extensions and continuations of the metallisations increase the length of the rf choke or chokes. In yet further embodiments, the metallisation extending over the conical section 9 may be replaced by a metal component brazed thereto, but this is likely to be more difficult to fabricate.

With reference to FIG. 2, another electron beam tube is similar to that shown in FIG. 1, but in this embodiment the ceramic cylinder 21 has a conical section 22 in which the outer diameter of the ceramic cylinder 21 increases in the direction of the electron beam but its inner diameter remains constant, over the axial length shown at 23. Thus the thickness of the ceramic wall is non-uniform. The inner surface of the ceramic cylinder includes a ridge or step 24 for mounting the grid support 25. In this embodiment also, metal parts of the rf chokes 26 and 27 extend beyond the straight-sided sections 28 and 29.

We claim:

1. An electron beam tube for use in amplifying a high frequency signal comprising: an electron gun; a vacuum envelope which contains said electron gun, said vacuum envelope including a ceramic cylinder having two straight-sided sections with a conical section between them, said straight sided sections forming part of r.f. choke means.

2. A tube as claimed in claim 1 and including metallisation on the outer surface of at least one of said straight sided sections.

3. A tube as claimed in claim 2 and including metallisation on the inner surface of at least one of said straight-sided sections.

4. A tube as claimed in claim 1 and including metallisation on the inner surface of at least one of said straight sided-sections.

5. A tube as claimed in claim 1 wherein said conical section is included in said rf choke means.

6. A tube as claimed in claim 4 and including metallisation on at least one of the outer and inner surface of said conical section.

7. A tube as claimed in claim 1 wherein said ceramic wall has a substantially uniform thickness at said straight-sided sections and said conical section.

8. A tube as claimed in claim 1 wherein the diameter of said conical section increases in the direction in which electrons emitted by said electron gun travel.

9. A tube as claimed in claim 1 and including metallisation on the inner surface of said ceramic cylinder via which electrical potentials are applied to at least one electrode of the electron gun.

10. A tube arrangement including a tube as claimed in claim 1 and including a high frequency resonant cavity-forming part located around said ceramic cylinder and making contact with said straight-sided sections thereof.

11. A tube arrangement as claimed in claim 10 wherein said cavity-forming part makes contact with metallisation on the outer surface of at least one of said straight-sided sections.

12. The electron beam tube of claim 1 further comprising a high frequency resonant cavity-forming part.

13. A cavity-forming part as claimed in claim 12 which comprises inner and outer walls which are substantially parallel to the longitudinal axis of the tube when the part is fixed to the tube, and first and second walls which are substantially normal to the axis of the tube when the part is fixed to the tube, wherein the first and second walls each have a central aperture of a diameter which corresponds to the outer diameter of the ceramic cylinder at respective ones of the straight-sided sections.

14. The electron beam tube of claim 1 further comprising an inductive output tube amplifier.

* * * * *